US005927206A

United States Patent [19]

Bacon et al.

[11] Patent Number: 5,927,206

[45] Date of Patent: Jul. 27, 1999

[54] FERROELECTRIC IMAGING MEMBER AND METHODS OF USE

[75] Inventors: Robert E. Bacon; Arun K. Mehrotra; Mark Lelental, all of Rochester; Daniel J. Gisser, Pittsford, all of N.Y.

[73] Assignee: Eastman Kodak Company, Rochester, N.Y.

[21] Appl. No.: 08/995,311

[22] Filed: Dec. 22, 1997

[51] Int. Cl.[6] ..... B41N 1/14

[52] U.S. Cl. ..... 101/453; 101/463.1; 101/465; 101/467; 347/120

[58] Field of Search ..... 101/454, 455, 101/457, 458, 462, 463.1, 465, 466, 467, 478, 453; 347/120, 141, 142, 151, 154

[56] References Cited

U.S. PATENT DOCUMENTS

| | | | |
|---|---|---|---|
| 4,748,464 | 5/1988 | Pannekoek et al. | 347/141 |
| 4,833,990 | 5/1989 | Hirt et al. | 101/467 |
| 4,872,962 | 10/1989 | Scheer et al. | 101/467 |
| 4,959,668 | 9/1990 | Hirt | 101/467 |
| 5,191,834 | 3/1993 | Fuhrmann et al. | 101/467 |
| 5,194,881 | 3/1993 | Hirt | 101/467 |
| 5,211,113 | 5/1993 | Buschulte | 101/467 |
| 5,402,158 | 3/1995 | Larson | 347/151 |
| 5,454,318 | 10/1995 | Hirt et al. | 101/453 |
| 5,555,809 | 9/1996 | Hirt et al. | 101/451 |
| 5,640,189 | 6/1997 | Ohno et al. | 347/141 |
| 5,786,048 | 7/1998 | Gesemann et al. | 101/328 |

FOREIGN PATENT DOCUMENTS

| | | |
|---|---|---|
| 2 157 810 | 3/1996 | Canada . |
| 0 704 770 A3 | 4/1996 | European Pat. Off. . |

*Primary Examiner*—Stephen R. Funk
*Attorney, Agent, or Firm*—J. Lanny Tucker

[57] ABSTRACT

An imagewise polarizable imaging member can be used to print the same or different images with an electrically responsive marking media. The imaging member includes a matrix-addressable microelectronic layer in proximate relationship with an imagewise polarizable ferroelectric layer. Imaging is accomplished by forming an imagewise electrical pattern in the ferroelectric layer using signals from the matrix-addressable microelectronic layer, and applying the electrically responsive marking media to the electrically polarized ferroelectric layer, creating thereon an identifiable image pattern. The marking media can then be transferred to a suitable receiver material to form the desired printed image.

20 Claims, 1 Drawing Sheet

FERROELECTRIC IMAGING MEMBER AND METHODS OF USE

FIELD OF THE INVENTION

This invention relates in general to imaging members that can be used to provide printed images from various information sources, but particularly digital information sources. More particularly, it relates to imaging members that exhibit a ferroelectric effect, and to methods of imaging and printing using such members.

BACKGROUND OF THE INVENTION

Most practical printing technologies can be roughly divided into three categories: (1) those that utilize some kind of printing member on which the image to be printed is recorded or impressed more or less permanently prior to the printing operation, (2) those that employ a photo- or electrosensitive element upon which the image to be printed is recorded and colorant is applied (or generated) prior to each printing operation, and (3) those that involve some type of plateless, direct imagewise colorant transfer from a "donor" element or reservoir to a receiving medium to create each print. Examples of the first type of printing include offset printing (i.e. lithography), letterpress printing and common rubber stamps. Examples of the second type of printing include xerography, electrophotography and electrography, and examples of the third type of printing include ink-jet, laser and thermal dye transfer printing. Lithography can involve the use of "wet" or "dry", and conventional processing or "processless", imaging techniques.

Each of these printing technologies has advantages and disadvantages for specific printing applications. Thus, each individual technology generally is limited to specific printing applications.

The art of lithographic printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth and the like, either directly or by using a blanket roller.

Aluminum has been used for many years as a support for lithographic printing plates. In order to prepare the plate for use, it is typical to subject it to one or more treatments to improve adhesion of radiation-sensitive materials, and to enhance the water-receptive characteristics of the support. A wide variety of radiation-sensitive materials suitable for forming images for use in the lithographic printing process are known for application to the noted supports.

Such lithographic printing plates are not readily reused. Reuse requires expensive and labor-intensive removal of residual imaging materials and layers, as well as residue from support treatments. In order to clean the capillaries in the surface of the treated support of such plates, deep-acting cleansers must be used in a lengthy cleaning process.

Moreover, lithographic printing plates of the type described above are usually "wet" processed using an alkaline developing solution after imagewise exposure. The developing solution, which is used to remove the non-image areas of the imaging layer, frequently includes a substantial amount of organic solvent. The need to use and dispose of substantial quantities of alkaline developing solution has long been a health and environmental concern in the printing art. Thus, efforts have been made for many years to provide a means for printing that does not require the use of an alkaline developing solution.

Lithographic printing plates designed to be used without such solutions have been proposed in the patent and technical literature. Some are commercially available. Thus far, they have suffered from one or more disadvantages which limit their usefulness. For example, some plates have lacked a sufficient degree of discrimination between oleophilic image areas and hydrophilic non-image areas with the result that image quality on printing is poor. Other plates have had oleophilic image areas which are not sufficiently durable to permit long printing runs. Still other plates have had hydrophilic non-image areas that are easily scratched and worn, or they have been unduly complex and costly by virtue of the need to coat multiple layers on the support. Some "wet processless" printing systems require the use of donor and receiver elements, or need rubbing or complicated debris removal equipment.

The lithographic printing plates described hereinabove are printing plates which are employed in a process which employs both a printing ink and an aqueous fountain solution. Also well known in the lithographic printing art are "waterless" printing plates that do not require the use of a fountain solution. Such plates have a lithographic printing surface comprised of oleophilic (ink-accepting) image areas and oleophobic (ink-repellent) background areas. They typically comprise a support, a radiation sensitive layer that overlies the support, and an oleophobic silicone rubber outer layer, and are subjected to the steps of imagewise exposure to form the lithographic printing surface. Lasers are typically used for imaging. In such instances, the laser imaging conditions "ablate" or partially or totally remove one or more layers in the image areas of the printing plates.

While such imaging methods are useful in many instances, there is a need to dispose of the "ablated" debris from the image areas. This can be done by wiping, washing, vacuum or other mechanical means. This step, while essential in such methods, complicates the imaging and printing processes, requiring more complicated imaging equipment and/or cleaning solutions. Hence, there is a desire in the art to avoid the use of "ablation" imaging if possible for this reason.

Another problem with "ablatable" printing plates is that they cannot be reused, and they still present an environmental problem with disposal of debris and the plate itself after printing. Researchers have been considering printing materials from which the image can be "erased", and the plate thereby reused. Erasable zirconia ceramic imaging materials and methods are described, for example, in copending and recently allowed U.S. Ser. No. 08/576,178 (filed Dec. 21, 1995 by Ghosh et al) now U.S. Pat. No. 5,743,188 issued Apr. 28, 1998.

Erasable printing members composed of ferroelectric materials and useful for offset printing are described in U.S. Pat. No. 5,454,318 (Hirt et al), U.S. Pat. No. 5,555,809 (Hirt et al), CA 2,157,810 (Weiss et al) and by Hirt et al, *Integrated Ferroelectrics*, 10, pp. 319–326 (1995). Such printing members are used when hydrophobic and hydrophilic areas are formed in an imagewise fashion on a ferroelectric material from irradiation. This material can be polarized and depolarized in selected areas or can be brought into the three different polarization states (positive or negative polarization, or depolarization). A printing member is polarized by applying an electrical (D.C.) voltage to an electrode and using an electrically conductive layer beneath the ferroelectric material as a counter-electrode. Alternatively, the printing member can have an outer layer having strong micro-dipoles. In the U.S. patents, various overcoat materials are applied to the printing member in image areas to provide greater wearability. Various materials, such as barium titanate, lead zirconium titanates or a composite material embedded with ferroelectric crystallites, that have ferroelectric properties are well known for this purpose.

These described imaging members have the disadvantage, however, in that they require a more complicated and cumbersome imaging procedure. For example, an electromechanical step is required for electrical polarization of the imaging member.

The integration of ferroelectric ceramic layers with single-crystalline microelectronic elements has been used to make infra-red detectors and what are known as microelectronic machines (MEM's). They have also been used for microelectronic memory elements or devices (Fe-RAM) that require no applied voltage or refresh signal to maintain their polarization.

It would be desirable to have a printing technology that can be readily adapted to a wide variety of printing applications, and that has various advantages over the several technologies described above. Thus, it would be desirable to have a printing member that can be used to deliver a unique image for each printing step, or provide a number of identical prints of the same image without reexposure or reimaging before every printing step. It would also be desirable to avoid the environmental, health and operational problems accompanying the more conventional lithographic printing technologies and printing materials described above. For example, it is desirable to avoid the need for post-imaging processing solutions, for cleaning the supports before reuse, or the need to dispose of imaging debris. The printing members should also be simple to use, erasable and reusable.

SUMMARY OF THE INVENTION

In accordance with this invention, an imagewise polarizable imaging member comprises a support, having thereon:

an amorphous, polycrystalline or single crystalline matrix-addressable microelectronic layer, and in proximity thereto, an imagewise polarizable ferroelectric layer.

This invention is also a method of providing an image comprising the steps of:

A) providing the imaging member as described above,

B) electrically polarizing the ferroelectric layer using electrical signals from the matrix-addressable microelectronic layer, providing an imagewise polarized electrical pattern in the ferroelectric layer, and C) applying electrical pattern-responsive marking media to the electrically polarized ferroelectric layer, creating thereon an identifiable image pattern.

Moreover, this invention also provides a method of printing, comprising the steps A, B and C identified above, and additionally:

D) contacting the electrically polarized ferroelectric layer with a receiver element or material, thereby transferring the identifiable marking media to the receiver material in an imagewise fashion.

The printing member of this invention combines the use of thin-film ferroelectric layers with an addressable microelectronic layer such as are common in the art for memory and display applications. In practice, the ferroelectric layer is poled, in an imagewise fashion, using digital data signals supplied to the underlying microelectronic layer with which it is integrated. As in the case of Fe-RAM devices, the ferroelectric layer retains the polarization without the need to continue applying the imagewise electrical signals. The imagewise pattern of electrical polarization can then be identifiably marked using a suitable marking media (such as an electrical pattern-responsive toner or lithographic ink) for subsequent transfer to a suitable receiving material such as a printing "blanket" roller or other receiver material to provide a desired impression or "print".

Moreover, if a new image is needed for the next impression, a new electrical signal can be applied to all or a part of the ferroelectric layer before the marking media is reapplied. Otherwise, the ferroelectric layer keeps the same imagewise polarized electrical pattern while it is marked for as many successive impressions as are desired. Thus, input of data from the microelectronic layer is not needed for every impression.

In alternative embodiments, the imaging member can include an overcoat layer over the ferroelectric layer that can have various chemical or physical properties that can be modified by the electrical input to the ferroelectric layer from the microelectronic layer. For example, the electrical input can be used to change the overcoat layer hydrophilicity in an imagewise pattern. Other changes to the overcoat layer could be changes in oleophilicity, polarity, surface energy or adhesive properties.

DETAILED DESCRIPTION OF THE INVENTION

Figure 1:
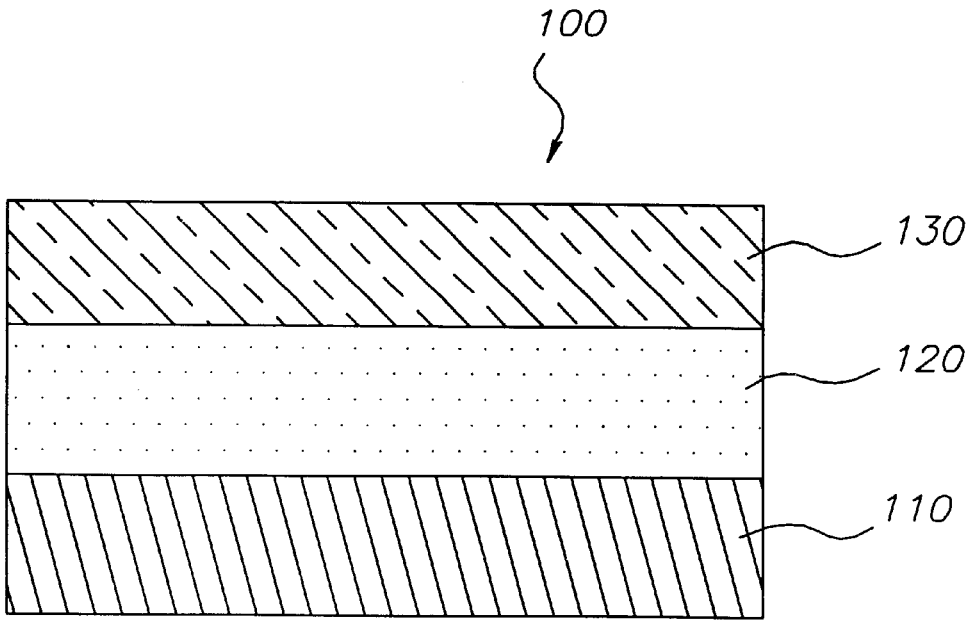
FIG. 1 is a schematic cross-sectional view of a preferred imaging member of this invention.

The preferred imaging member of this invention can be represented by FIG. 1, in which imaging member 100 is composed of support 110 having thereon matrix-addressable microelectronic layer 120 and in proximity thereto (in this case, adjacent thereto), imagewise polarizable ferroelectric layer 130.

Figure 2:
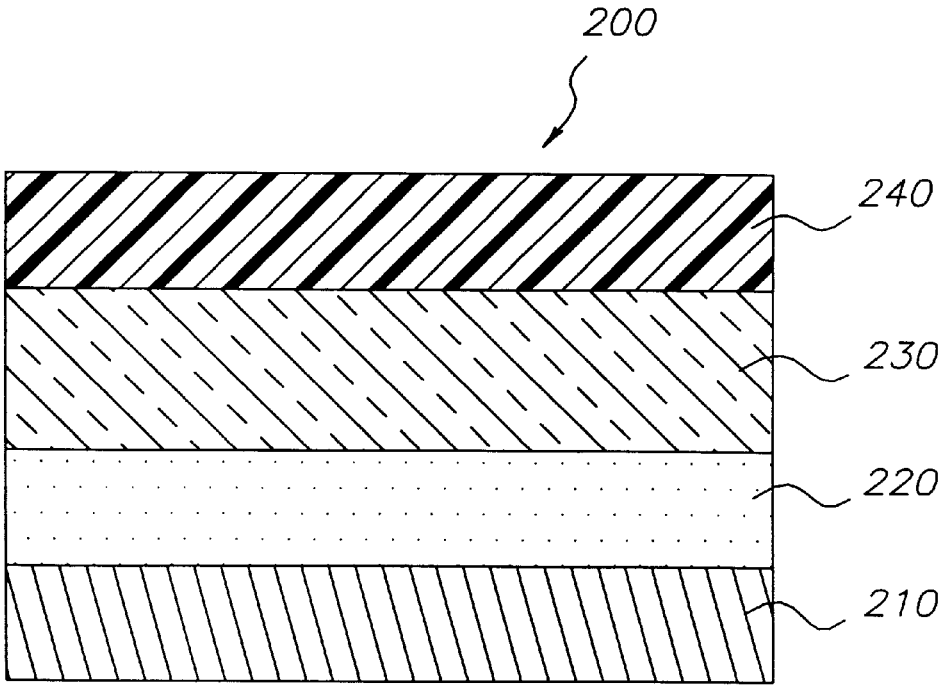
FIG. 2 is a schematic cross-sectional view of an alternative imaging member of this invention having an overcoat.

An alternative imaging member 200 is shown in FIG. 2 as having support 210 having thereon matrix-addressable microelectronic layer 220, imagewise polarizable ferroelectric layer 230, and overcoat layer 240.

The imaging member support can be composed of any semiconductor-coated rigid, semi-rigid or flexible material, including silicon-coated metals, glass, non-ferroelectric ceramics, rigid resin-coated or uncoated papers, polymeric films (including polyesters, polystyrenes, polycarbonates, polyacrylates, polyimides, polyolefins and polyestersulfones). Particularly useful polyester supports are those prepared from polyethylene terephthalate and polyethylene naphthalate. Preferably, the support is a flexible silicon-coated support. The support can be of any desirable thickness or porosity.

The microelectronic layer used in the present invention to receive and transmit imaging data to the ferroelectric layer, is composed of one or more arrays of electronic switches, such as thin film transistors or metal-insulator-metal diodes. Such layers are also known as integrated circuits (IC's). The arrays can be arranged in single or multiple rows. IC's useful in this invention are commonly employed in other devices, including DRAM and active-matrix displays, liquid crystal displays (LCD), and are commercially available from a number of sources. They can be composed of amorphous, polycrystalline or single crystalline silicon, gallium arsenide or other semiconductive materials, that are appropriately fabricated into active, pixelated "elements" at a spatial density high enough to deliver digital information in desired printing resolutions. Preferably, they are composed of amorphous or polycrystalline silicon semiconductors.

Alternatively, a passive matrix addressing grid can be used to form the microelectronic layer useful in this invention, as described for example in U.S. Pat. No. 5,682,177 (Kuwata et al), U.S. Pat. No. 5,621,425 (Hoshino et al), U.S. Pat. No. 5,563,624 (Imamura), U.S. Pat. No. 5,657,043 (Fukui et al), U.S. Pat. No. 5,473,338 (Prince et al) and U.S. Pat. No. 5,644,330 (Catchpole et al), incorporated herein by reference.

The construction of various types of microelectronic layers having arrays of thin film transistors and their various characteristics are well known in the art, including U.S. Pat. No. 5,550,066 (Tang et al), U.S. Pat. No. 5,634,835 (Wu ct al), U.S. Pat. No. 5,339,180 (Katoh), U.S. Pat. No. 5,426,074 (Brody), U.S. Pat. No. 5,526,013 (Ono et al), U.S. Pat. No. 5,409,851 (Oh), U.S. Pat. No. 5,572,211 (Erhart et al), U.S. Pat. No. 5,384,064 (Geelhaar et al), U.S. Pat. No. 5,589,847 (Lewis), EP-A-0 717 445 (Tang et al) and EP-A-0 717 446 (Tang et al), incorporated herein by reference, and the many publications noted therein. Such materials are also described by Castellano, *Handbook of Display Technology*, Academic Press, 1992.

The thickness of such microelectronic layers in the imaging member of this invention can vary depending upon the printing member configuration, components, use and other factors readily apparent to one skilled in the art.

The polarizable ferroelectric layer is situated "in proximity to" the microelectronic layer. As used herein, "in proximity to" means that the two layers are at least in electrical contact so that the imagewise electrical signals can be communicated from the microelectronic layer to the ferroelectric layer. In most cases, the two layers are contiguous or adjacent as shown in FIGS. 1 and 2, but in other embodiments, there may be interposed thin intermediate layers composed of polarizable dielectric materials.

Polarizable ferroelectric materials are well known, described for example, in the Hirt et al patents noted above. Such materials include, but are not limited to, tungsten bronzes (such as strontium-barium-tantalate and bariumlathanum-titanium-niobate), perovskite ceramics that contains a ferroelectric component (such as barium-titanate, lead-zirconium-titanate, lead-lanthanumzirconium-titanate, barium-strontium-titanate, and other materials readily apparent to a worker skilled in the art), and ferroelectric polymers (such as polyvinylidine fluoride). Other materials would be readily apparent to one skilled in the art. The thin film perovskite ceramics are preferred to form a polarizable ferroelectric ceramic layer.

The outer surface of the ferroelectric layer need not be composed exclusively of the polarizable ferroelectric material. It is also sufficient that ferroelectric crystallites be embedded randomly or in a favorable orientation within another material, such as an inorganic or organic polymer, glass, ceramic or other suitable material, such that the entire surface is polarizable from the electrical signals supplied by the microelectronic layer.

The thickness of the polarizable ferroelectric layer can vary depending upon the particular form or shape of the imaging member, the materials used and the desired use of the imaging member, as would be readily apparent to one skilled in the art.

As noted above, one embodiment of the imaging member includes an overcoat on the ferroelectrie layer that can serve one or more functions. For example, it can merely serve as a dielectric protective overcoat to hold an electrical charge pattern. Such overcoat layers can be composed of protective polymers that can hold a charge so the marking media (described below) applied thereto is responsive to the electrical pattern formed underneath the overcoat.

Alternatively, the overcoat can be composed of a material that, upon electrical polarization of the underlying ferroelectric layer, can be changed in chemical or physical properties, such as hydrophilicity, oleophilicity, polarity, surface energy or adhesive properties, in response to the electrical polarization.

The printing members of this invention can be of any useful form including, but not limited to, printing plates, printing cylinders, printing sleeves, and printing tapes (including flexible printing webs). Printing plates can be of any useful size and shape (for example, square or rectangular). Printing cylinders and sleeves can be composed of the printing member throughout, or the printing member can be in a rotary form on a separate substrate. Hollow or solid metal cores can be used as substrates if desired. The printing tapes can be of any useful length, width or flexibility. Preferably, the imaging member is a printing plate.

In practicing the imaging method of this invention, the imaging member described above is provided with an imagewise electrical polarization pattern in the ferroelectric layer using electrical signals from the microelectronic layer. Electrical pattern-responsive marking media are then applied to the electrically polarized ferroelectric layer (or overcoat), creating thereon an identifiable image pattern. In the most usual methods, such marking media include electrically responsive colorants that can be dry toners, or solvent-dispersed pigments (such as liquid toners) or dyes (such as lithographic inks). Such colorants can be a single color, or mixtures of colors can be used. Useful dry toner materials are well known in the electrophotographic art, and are described, for example, in U.S. Pat. No. 5,486,444 (Bayley et al), U.S. Pat. No. 5,462,829 (Tyagi et al) and U.S. Pat. No. 5,587,265 (Nakadera et al) all incorporated herein by reference. Lithographic inks are also well known and available from a number of commercial sources. Representative lithographic inks are described, for example, in *Pocket Pal. A Graphic Arts Production Handbook*, International Paper, 16th Edition, 1995, pp. 139–147.

The marking media can also be applied to imaging members having an overcoat layer. Thus, depending upon what purpose the overcoat layer serves, the marking media are responsive to the electrical pattern in some manner to provide an identifiable pattern on the overcoat. For example, the marking media can be the electrical pattern responsive colorant described above if the overcoat is a dielectric material. If the overcoat layer is changed in other physical or chemical characteristics in response to the electrical pattern, the marking media can be tailored to be responsive thereto. For example, if the overcoat layer is changed in hydrophilicity, the marking media can be responsive to a more hydrophilic or hydrophobic pattern (such as ink). Other marking media would be readily apparent to one skilled in the art.

One useful means of printing would be to contact the imaging member (with or without overcoat) with a fountain solution and electrically charged ink to provide an inked image thereon.

The identifiable image pattern on the image member can then be transferred to any suitable receiver element or material placed in contact therewith, such as in conventional printing operations. Receiver materials include, but are not limited to, paper, plastics, metals, ceramics, fabrics and glass. The receiver element or material can be the final carrier of the image, or it can be a blanket roller in a printing press that is used to transfer the image to another receiver material that is the final image carrier.

Once an image has been generated and/or printed on a suitable receiver material, the imaging member can be "remarked" with the marking media to provide second and successive printed images. The imaging member does not have to be repolarized in such instances because it holds the imaging pattern on the ferroelectric layer (or overcoat).

Alternatively, one image pattern can be "erased" or modified in whole or part by sending new digital signals to the imaging member, thereby providing a different electrical pattern in the ferroelectric layer. Thus, the method of this invention can also include changing the polarized electrical pattern on the ferroelectric layer by localized or imagewise electrically repolarizing the ferroelectric layer using electrical signals from the microelectronic layer to provide a different imagewise polarized electrical pattern in the ferroelectric layer.

If the image pattern is changed in any manner between impressions, the imaging member can be cleaned, if desired, using any suitable chemical or mechanical cleaning means, such as wiping or rubbing with solvents or brushes.

The invention has been described in detail, with particular reference to certain preferred embodiments thereof, but it should be understood that variations and modifications can be effected within the spirit and scope of the invention.

We claim:

1. An imagewise polarizable imaging member comprising a support, having thereon:

an amorphous, polycrystalline or single crystalline matrix-addressable active matrix microelectronic layer, and in proximity thereto, an imagewise polarizable ferroelectric layer.

2. The imaging member of claim 1 further comprising a dielectric overcoat on said ferroelectric layer.

3. The imaging member of claim 1 further comprising an intermediate dielectric layer between said microelectronic and ferroelectric layers.

4. The imaging member of claim 1 wherein said ferroelectric layer is composed of a tungsten bronze or perovskite ceramic.

5. The imaging member of claim 4 wherein said ferroelectric layer is a perovskite ceramic composed of a barium-titanate, a lead-zirconate-titanite, a lead-lanthanum-zirconatc-titanate, or a barium-strontium-titanate ceramic.

6. The imaging member of claim 1 wherein said ferroelectric layer is composed of ferroelectric crystallites embedded within another material.

7. The imaging member of claim 1 wherein said matrix-addressable microelectronic layer is composed of an array of thin-film transistors.

8. The imaging member of claim 1 wherein said matrix-addressable microelectronic layer is composed of an array of metal-insulator-metal diodes.

9. The imaging member of claim 1 wherein said matrix-addressable microelectronic layer comprises an amorphous or polycrystalline silicon semiconductor.

10. The imaging member of claim 1 in the form of a printing plate.

11. The imaging member of claim 1 in the form of a printing cylinder or sleeve.

12. A method of providing an image comprising the steps of:

A) providing an imagewise polarizable imaging member comprising a support, having thereon:

an amorphous, polycrystalline or single crystalline matrix-addressable active matrix microelectronic layer, and in proximity thereto, an imagewise polarizable ferroelectric layer, B) electrically polarizing said ferroelectric layer using electrical signals from said matrix-addressable microelectronic layer, providing an imagewise polarized electrical pattern in said ferroelectric layer, and C) applying electrical pattern-responsive marking media to said electrically polarized ferroelectric layer, creating thereon an identifiable image pattern.

13. The method of claim 12 wherein said electrical signals are provided to said microelectronic layer from a digital data source.

14. The method of claim 12 further comprising the step:

D) contacting said electrically polarized ferroelectric layer with a receiver material, thereby transferring said identifiable marking media to said receiver material in an imagewise fashion.

15. The method of claim 12 comprising changing said polarized electrical pattern in whole or part on said ferroelectric layer by localized or imagewise electrically repolarizing said ferroelectric layer using electrical signals from said matrix-addressable microelectronic layer to provide a different imagewise polarized electrical pattern in said ferroelectric layer.

16. The method of claim 12 wherein said marking media comprises an electrically responsive colorant.

17. The method of claim 16 wherein said marking media comprises an electrically responsive dry toner material.

18. The method of claim 16 wherein said marking media comprises a lithographic ink.

19. The method of claim 12 wherein said imaging member further comprises an overcoat layer, and said marking media comprises an electrically responsive colorant.

20. The method of claim 12 wherein said imaging member further comprises an overcoat layer, and the hydrophilicity, oleophilicity, polarity, surface energy or adhesive properties of said overcoat layer are changed by generation of said imagewise polarized electrical pattern in said ferroelectric layer.

* * * * *